US010488096B2

(12) United States Patent
Kim et al.

(10) Patent No.: US 10,488,096 B2
(45) Date of Patent: Nov. 26, 2019

(54) REFRIGERATOR

(71) Applicant: LG ELECTRONICS INC., Seoul (KR)

(72) Inventors: Seongjae Kim, Seoul (KR); Seunghwan Oh, Seoul (KR); Heayoun Sul, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/549,917

(22) PCT Filed: Feb. 5, 2016

(86) PCT No.: PCT/KR2016/001334
§ 371 (c)(1),
(2) Date: Aug. 9, 2017

(87) PCT Pub. No.: WO2016/129906
PCT Pub. Date: Aug. 18, 2016

(65) Prior Publication Data

US 2018/0031298 A1 Feb. 1, 2018

(30) Foreign Application Priority Data

Feb. 9, 2015 (KR) ..... 10-2015-0019597

(51) Int. Cl.
*F25D 11/02* (2006.01)
*F25B 21/02* (2006.01)
(Continued)

(52) U.S. Cl.
CPC ..... *F25D 11/025* (2013.01); *F25B 5/02* (2013.01); *F25B 21/02* (2013.01); *F25B 25/00* (2013.01);
(Continued)

(58) Field of Classification Search
CPC ..... F25B 21/02; F25B 2321/02; F25D 11/02; F25D 11/022; F25D 25/025; F25D 2400/28; F25D 2400/30
See application file for complete search history.

(56) References Cited

U.S. PATENT DOCUMENTS 2,675,687 A * 4/1954 Phillip ..... F25B 39/02 220/592.05
2010/0126200 A1* 5/2010 Oh ..... F25D 17/065 62/335

(Continued)

FOREIGN PATENT DOCUMENTS

JP 2011112232 6/2011
KR 10-2012-0133287 12/2012

(Continued)

*Primary Examiner* — Brian M King
(74) *Attorney, Agent, or Firm* — Fish & Richardon P.C.

(57) ABSTRACT

A refrigerator according to an embodiment of the present invention includes a cabinet in which a storage space is formed; a main evaporator which is installed at one side of an inner portion of the storage space to cool the storage space; a case which is installed on the other side of the inner portion of the storage space and defines a deep-freezing storage chamber; a drawer which is accommodated in the case so as to be retractable and withdrawable and in which food is stored; and a rapid cooling module which is provided on a rear side of the inner portion of the case and rapidly cools the deep-freezing storage chamber, in which the rapid cooling module may includes an auxiliary evaporator; and a thermoelectric device which is coupled to the auxiliary evaporator and cools the deep-freezing storage chamber through heat exchange by heat conduction.

9 Claims, 4 Drawing Sheets

(51) Int. Cl.

| | |
|---|---|
| ***F25B 5/02*** | (2006.01) |
| ***F25B 25/00*** | (2006.01) |
| ***F25B 41/06*** | (2006.01) |
| ***F25D 25/02*** | (2006.01) |
| ***F25D 17/06*** | (2006.01) |
| ***F25D 19/04*** | (2006.01) |

(52) U.S. Cl.
CPC ..... *F25B 41/062* (2013.01); *F25D 11/022* (2013.01); *F25D 17/065* (2013.01); *F25D 19/04* (2013.01); *F25D 25/025* (2013.01); *F25B 2321/0251* (2013.01); *F25B 2321/0252* (2013.01); *F25B 2341/0661* (2013.01); *F25D 2317/061* (2013.01); *F25D 2323/021* (2013.01); *F25D 2400/04* (2013.01); *F25D 2400/28* (2013.01)

(56) References Cited

U.S. PATENT DOCUMENTS

| | | | | |
|---|---|---|---|---|
| 2012/0304667 | A1* | 12/2012 | Shin | F25B 21/02 62/3.6 |
| 2016/0282032 | A1* | 9/2016 | Gomes | F25D 11/022 |

FOREIGN PATENT DOCUMENTS

| | | |
|---|---|---|
| KR | 10-2013-0049496 | 5/2013 |
| KR | 10-2014-0019588 | 2/2014 |
| KR | 10-2014-0119443 | 10/2014 |
| WO | 2009139591 | 11/2009 |

* cited by examiner

[Fig.1]
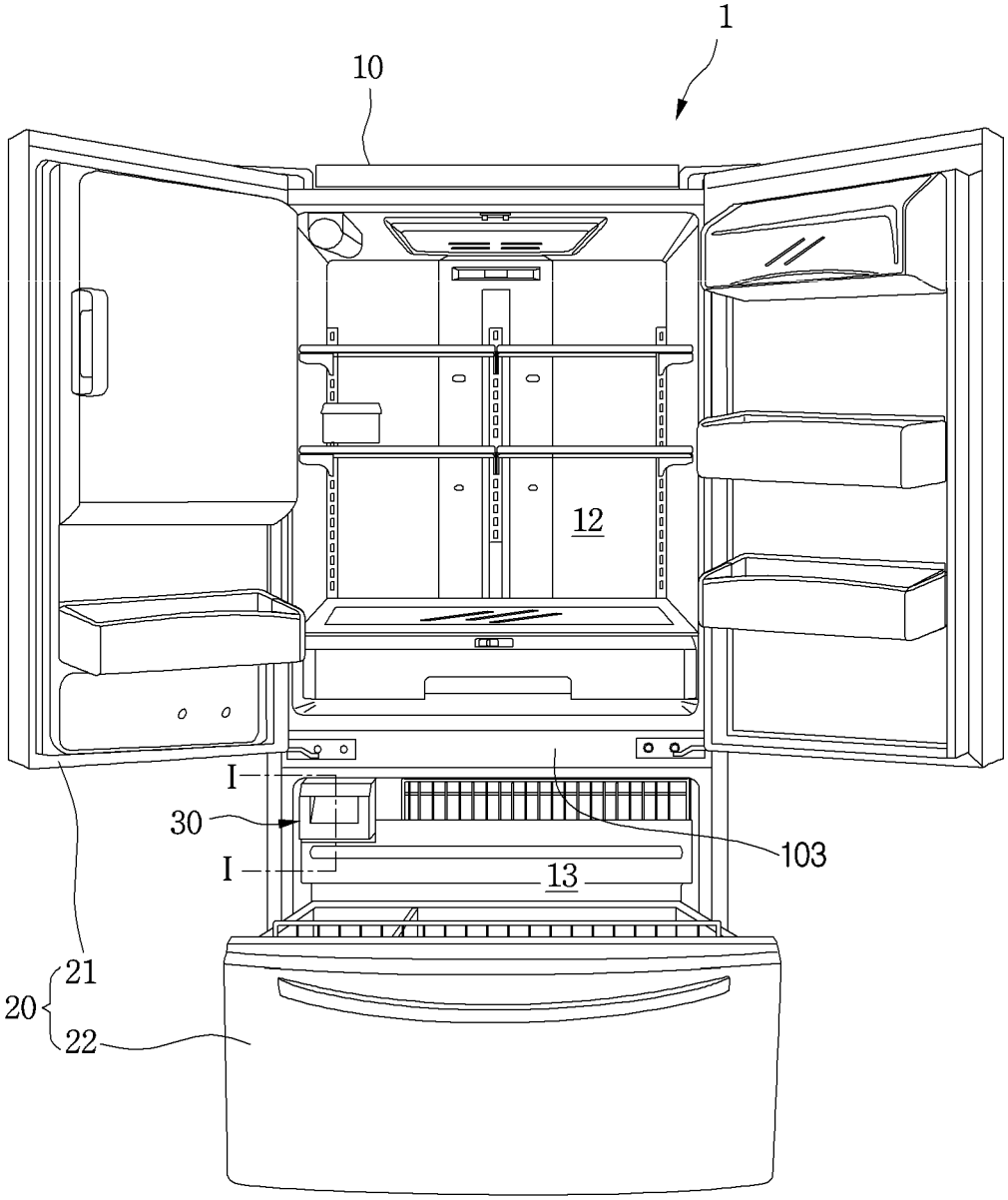

[Fig.2]
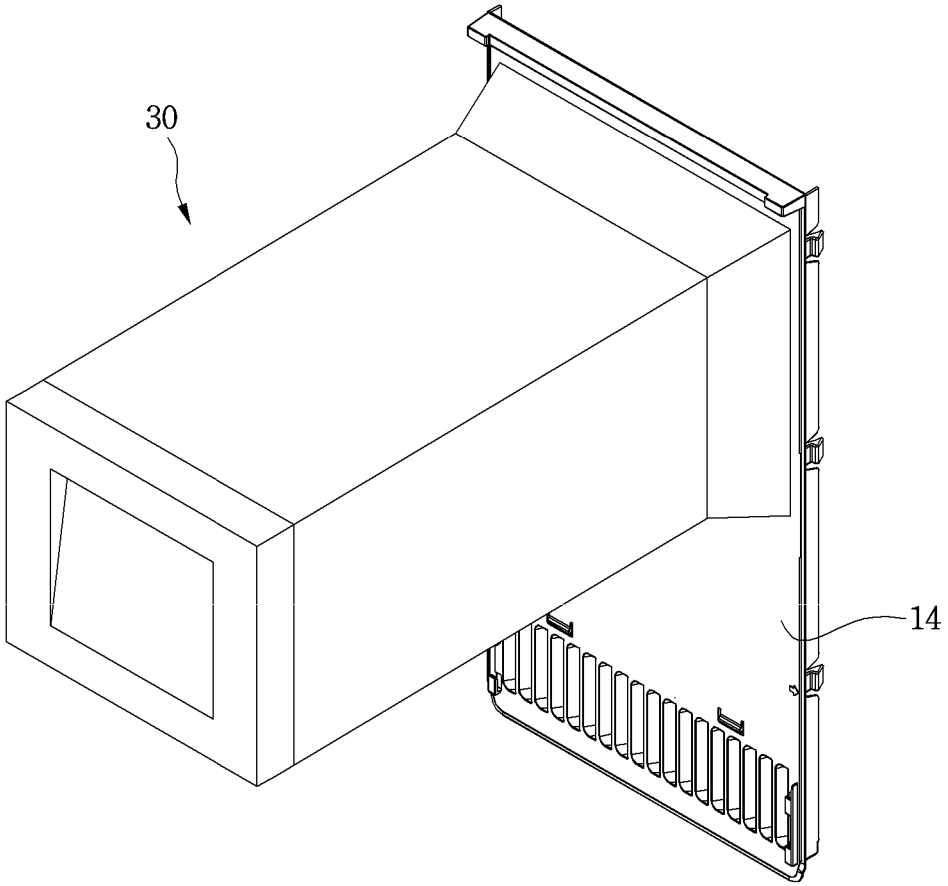

[Fig.3]
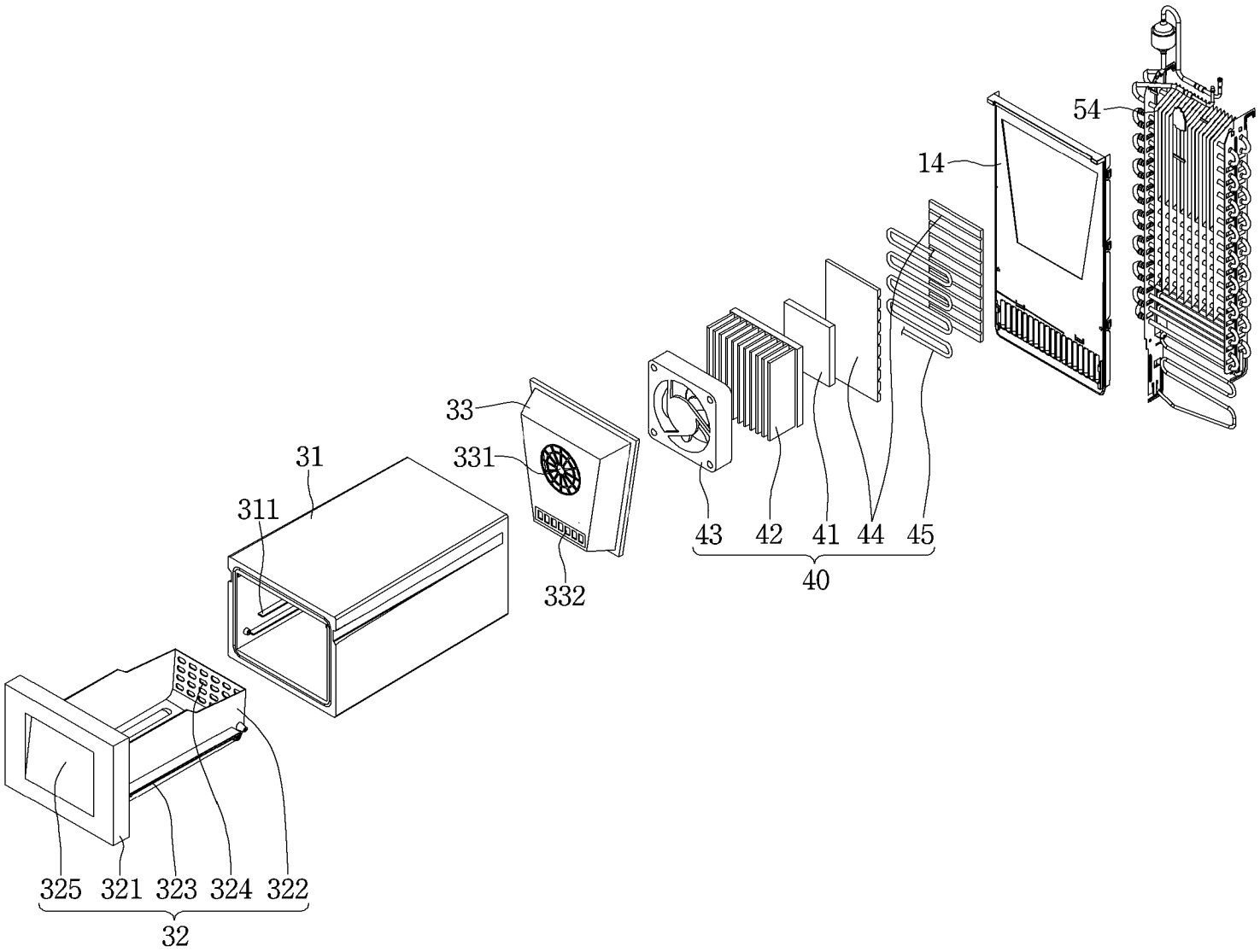

[Fig.4]
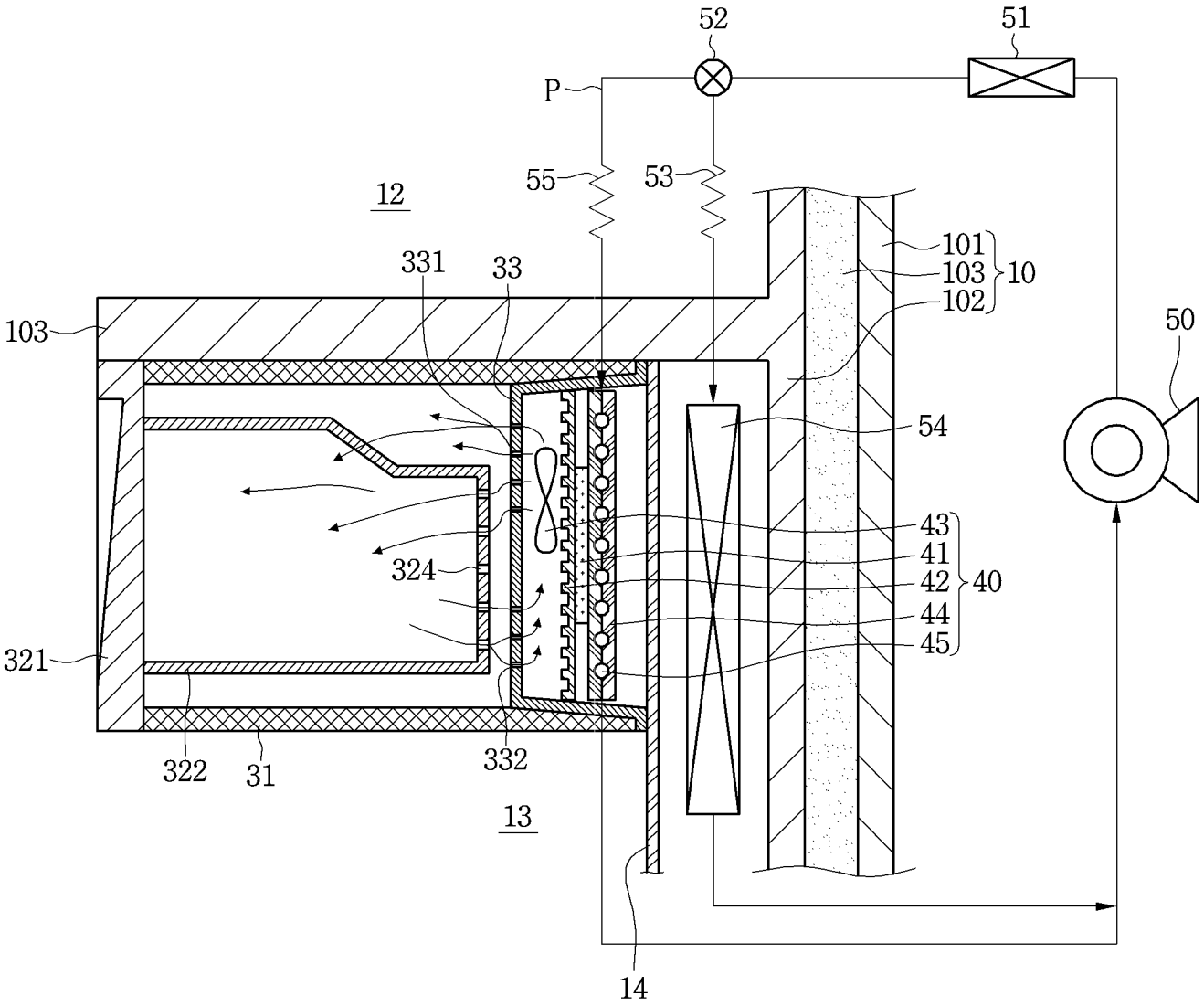

REFRIGERATOR

CROSS-REFERENCE TO RELATED APPLICATIONS

This application is a National Stage application under 35 U.S.C. § 371 of International Application No. PCT/KR2016/001334, filed Feb. 5, 2016, which claims the benefit of Korean Application No. 10-2015-0019597, filed on Feb. 9, 2015. The disclosures of the prior applications are incorporated by reference in their entirety.

TECHNICAL FIELD

The present invention relates to a refrigerator.

BACKGROUND ART

Generally, a refrigerator is a household appliance that can store food at low temperature in a storage space of inner portion thereof that is shielded by a door. To this end, the refrigerator is configured to be capable of storing stored food in an optimal state by cooling the inner portion of the storage space using cooled air generated through heat exchange with the refrigerant circulating in the refrigeration cycle.

Recently, refrigerators have become increasingly larger and multifunctional in accordance with trend of changes in dietary life and high quality of products, and refrigerators having various structures and convenience devices considering convenience of users have been released.

Particularly, when the meat or fish is frozen, if a freezing point temperature range at which ice in the cell thereof is formed is passed in a short time, the destruction of the cell thereof is minimized and thus there are advantages the the meat quality is kept fresh even after thawing of the meat and delicious food can be cooked.

For this reason, there is an increasing demand of consumers for a separate storage space which can cool food at a temperature lower than the freezing chamber temperature in a short time, in addition to a refrigerating chamber or a freezing chamber.

In a case of the refrigerator having the rapid cooling function disclosed in Korean. Patent Laid-Open. No. 10-2013-0049496 (May 14, 2013) as the related art, the temperature of a quenching chamber can be made lower than the temperature of the freezing chamber by an exothermic surface of a thermoelectric device being attached to a freezing chamber evaporator mounted on a rear side of the freezing chamber and the endothermic surface of the thermoelectric device being installed to face the quenching chamber. According to the structure of the related art described above, since heat is transferred to the freezing chamber evaporator, there is a disadvantage in freezing chamber cooling.

In addition, there is a limit in the maximum temperature difference which can be produced by the freezing chamber evaporator and thermoelectric device and there is a disadvantage that the discharge temperature of the cooled air of the quenching chamber is unlikely to be lowered to minus 40 degrees Celsius or less.

DISCLOSURE

Technical Problem

The present invention has been made in order to solve the problems or the related art and an objective of the present invention is to provide a refrigerator which can rapidly cool the quenching chamber temperature to minus 50 degrees Celsius.

Technical Solution

According to an aspect of the present invention to achieve the object described above, there is provided a refrigerator including: a cabinet in which a storage space is formed; a main evaporator which is installed at a side of an inner portion of the storage space to cool the storage space; a case which is installed on the other side of the inner portion of the storage space and defining a deep freezing storage chamber; a drawer which is accommodated in the case so as to be retractable and withdrawable and in which food is stored; and a rapid cooling module which is provided on a rear side of the inner portion of the case for rapidly cooling the deep-freezing storage chamber, in which the rapid cooling module may includes an auxiliary evaporator; and a thermoelectric device which is coupled to the auxiliary evaporator and cools the deep-freezing storage chamber through heat exchange by heat conduction.

Advantageous Effects

According to the refrigerator relating to the embodiment of the present invention having configurations described above, the temperature of refrigerant passing through a deep-freezing chamber dedicated evaporator is about minus 35 degrees Celsius and the temperature of the endothermic surface of the thermoelectric device is about minus 30 degrees Celsius. When a current is supplied to the thermoelectric device, the temperature difference between the exothermic surface and the endothermic surface of the thermoelectric device becomes about degrees and the endothermic surface temperature of the thermoelectric device becomes about minus 55 degrees Celsius. There is an advantage that the temperature of the cooled air of the deep-freezing chamber can be cooled down to about minus 50 degrees Celsius.

DESCRIPTION OF DRAWINGS

FIG. 1 is a perspective view of a refrigerator having a rapid cooling module according to an embodiment of the present invention;

FIG. 2 is an external perspective view of a deep-freezing storage chamber system according to an embodiment of the present invention;

FIG. 3 is an exploded perspective view of the deep-freezing storage chamber system; and FIG. 4 is system diagram schematically illustrating a refrigerant circulation system of the refrigerator including the deep-freezing storage chamber system according to an embodiment of the present invention.

BEST MODE

Hereinafter, a refrigerator according to an embodiment of the present invention will be described in detail with reference to the drawing. Hereinafter, although a bottom freezer-type refrigerator is which a freezing chamber is provided below a refrigerating chamber is described as an example of a refrigerator according to an embodiment of the present invention, the present invention is not limited thereto and can be also applied to all types of refrigerators.

FIG. 1 is a perspective view of a refrigerator having a rapid cooling module according to an embodiment of the present invention.

With reference to FIG. 1, a refrigerator 1 provided wish a rapid cooling module according to an embodiment of the present invention includes a main body 10 which has a storage space therein, a door 20 which selectively opens and closes the storage space, and a deep-freezing storage chamber which is provided independently inside a storage space.

Specifically, the inner space of the main body 10 is divided into a refrigerating chamber 12 and a freezing chamber 13 by a barrier 103. The freezing chamber 12 and the freezing chamber 13 are disposed in the lateral direction or in the vertical direction according to the extending direction of the barrier 103. For example, when the barrier 103 is placed in the lateral direction, the refrigerating chamber 12 is formed on an upper side or a lower side of the freezing chamber 13, and in the present embodiment, the refrigerating chamber 12 is disposed the upper side of the freezing chamber 13. Alternatively, when the barrier 103 is placed vertically, the refrigerating chamber 12 and the freezing chamber 13 may be disposed side by side in the lateral direction.

In addition, the deep-freezing storage chamber may be provided at one side edge of the freezing chamber 13 and the deep-freezing storage chamber includes a drawer assembly 30 which stores food and a rapid cooling module 40 (see FIG. 3) which rapidly freezes the drawer assembly 30. The rapid cooling module 40 is disposed at a rear end of the drawer assembly 30, which will be described in more detail below with reference to the drawings.

On the other hand, the refrigerating chamber 12 is selectively opened and closed by a refrigerating chamber door 21 and can be opened and closed by a single door or a pair of doors as illustrated in the drawings. The refrigerating chamber door 21 may be rotatably coupled to the main body 10.

In addition, the freezing chamber 13 is selectively opened and closed by the freezing chamber door 22, and in a case of the bottom freezer type refrigerator, the freezing chamber door 22 can be provided to be retractable and withdrawable as illustrated in drawings, that is, an accommodating portion of the freezing chamber can be provided in a form of a drawer.

On the other hand, the drawer assembly 30 can be accommodated in the deep-freezing storage chamber so as to be retractable and withdrawable in a front-rear direction.

FIG. 2 is an external perspective view of a deep-freezing storage chamber system according to an embodiment of the present invention, and FIG. 3 is an exploded perspective view of the deep-freezing storage chamber system.

With reference to FIGS. 2 and 3, a deep-freezing storage chamber assembly according to the embodiment of the present invention may include a drawer assembly 30 which defines a deep-freezing storage chamber and a rapid cooling module 40 for cooling an inner portion of the deep-freezing storage chamber to a temperature lower than a temperature of the freezing chamber in a short time.

Specifically, the drawer assembly 30 may include a case 31 which is fixedly mounted on one side of an inner portion of the refrigerating chamber 12 or the freezing chamber 13 and defines a deep-freezing storage chamber therein, and a drawer 32 which is coupled to be retractable and withdrawable to the inner portion of the case 31.

More specifically, the case 31 may have a hexahedral shape with at least a front surface opened and a rail guide 311 may be formed on inner circumferential surface of a side wall thereof to guide the retraction and the withdrawal of the drawer 32.

In addition, the drawer 32 may include a storage box 322 of which an upper surface is opened so as to store food therein, a box door 321 which is vertically coupled to a front surface of the storage box 322, and rails 323 which are formed on an outer circumferential surfaces of both side walls of the storage box 322. The rail 323 moves in the front-rear direction along the rail guide 311 to enable sliding movement of the drawer 32.

In addition, a plurality of cooled air holes 324 are formed on a rear surface of the storage box 322 so that cooled air can be circulated by cooled air supplied from the rapid cooling module 40 being supplied into the storage box 322 and the cooled air in the storage box 322 being returned to the rapid cooling module 40 side.

In addition, a handle portion 325 may be formed on a front surface of the box door 321.

On the other hand, the rear surface of the case 31 is in close contact with an evaporation chamber dividing wall 14. The evaporation chamber dividing wall 14 is a wall which divides an inner space of the freezing chamber 13 into a freezing storage chamber and an evaporation chamber in the front-rear direction and a main evaporator 54 which is defined as a freezing chamber evaporator is accommodated in a space formed between a rear wall of the cabinet 10 and the evaporation chamber dividing wall 14.

In addition, the rapid cooling module 40 is accommodated in the case 31 and is divided into the deep-freezing storage chamber and the deep-freezing evaporation chamber by a deep-freezing evaporation chamber cover 33. Specifically, the inner space of the case 31 corresponding to a front side of the deep-freezing evaporation chamber cover 33 is defined as the deep-freezing storage chamber and the inner space of the case 31 corresponding to a rear side of the deep-freezing evaporation chamber cover 33 can be defined as a deep-freezing evaporation chamber.

A discharge grill 331 and a suction grill 332 may be formed on a front surface of the deep-freezing evaporation chamber 33, respectively. The discharge grill 331 may be positioned above the suction grill 332 and cooled air cooled to a temperature lower than a temperature of the freezing chamber in the deep-freezing evaporation chamber is discharged to the deep-freezing storage chamber. The cooled air in the deep-freezing storage chamber is returned the deep-freezing evaporation chamber through the suction grill 332.

The rapid cooling module 40 is accommodated in the deep-freezing evaporation chamber. The rapid cooling module 40 may include a auxiliary evaporator 45 which is defined as a deep-freezing evaporator, a heat conduction unit 44 which is in close contact with an outer circumference of the auxiliary evaporator 45, a thermoelectric device 41 which is attached to a front surface of the heat conduction unit 44, a heat sink 42 which is in close contact with the front surface of the thermoelectric device 41, and a cooling fan 43 which is placed in front of the heat sink 42 to circulate the cooled air.

The thermoelectric device 41 may include a device using a Peltier effect in which an endothermic phenomenon occurs on one surface thereof and an exothermic phenomenon occurs on the other surface thereof due to current supply. The Peltier effect is an effect of causing the endothermic phenomenon at one terminal and the exothermic phenomenon at the other terminal depending on the current direction when two kinds of rapid ends are connected and current flows thereto. If the flow direction of the current supplied the thermoelectric device 41 is switched, the endothermic surface and the exothermic surface are also switched, and there is an advantage that the endothermic amount and the exothermic amount can be adjusted according to the amount of the supplied current.

The rapid cooling module 40 according to the present embodiment has a structure in which the endothermic surface of the thermoelectric device 41 is directed toward the drawer assembly 30 of the deep-freezing storage chamber and the exothermic surface is directed toward the auxiliary evaporator 45. Therefore, the rapid cooling module 40 can be used to rapidly cool the food stored in the drawer assembly 30 to a state of a cryogenic temperature state of minus 50 degrees Celsius or less by using the endothermic phenomenon generated in the thermoelectric device 41.

In addition, the heat conduction unit 44 may be a metal plate material having a high thermal conductivity such as an aluminum plate. One or a pair plates of the heat conduction unit 44 is tightly coupled to a refrigerant pipe of the auxiliary evaporator 45. In the present embodiment, a pair of heat conduction plate is proposed in form of wrapping a portion of the refrigerant pipe of the auxiliary evaporator.

FIG. 4 is system diagram schematically illustrating a refrigerant circulation system of the refrigerator including the deep-freezing storage chamber system according to an embodiment of the present invention.

With reference to FIG. 4, in the deep freezing storage chamber system according to the embodiment of the present invention, a freezing chamber evaporator 54, that is, a main evaporator 54 for supplying cooled air to the freezing chamber 13 and the refrigerating chamber 12 or to only the freezing chamber 13, and a deep-freezing storage chamber evaporator, that is, a auxiliary evaporator 45 for cooling the deep-freezing storage chamber are separately provided respectively.

Specifically, the refrigerant circulation system of the refrigerator 1 according to the embodiment of the present invention may include a compressor 50 for compressing the refrigerant into a high-temperature and high-pressure gas state, a condenser 51 for condensing the refrigerant passing through the compressor 50 into a high-temperature and high-pressure liquid state, a main expansion valve 53 which is provided at an outlet side of the condenser 51, the main evaporator 54 which is connected to an outlet side of the main expansion valve 53, a auxiliary expansion valve 55 which is branched at any point of a refrigerant pipe P connecting the main expansion valve 53 and the condenser 51 and thus is connected in parallel with the main expansion valve 53, and auxiliary evaporator 45 which is connected to an outlet side of the auxiliary expansion valve 55. A valve 52 may be mounted at a point where the main expansion valve 53 and the auxiliary expansion valve 55 are branched and may be controlled that the refrigerant passing through the condenser 51 separately flows into the main expansion valve 53 and the auxiliary expansion valve 55 or flows only to either side.

In addition, the cabinet 10 may include an outer cabinet 101, an inner cabinet 102, and a heat insulating layer 101 formed between the outer cabinet 101 and the inner cabinet 102. The refrigerating chamber 12 and the freezing chamber 13 are divided and defined by the inner cabinet 102 and the barrier 103. The evaporation chamber dividing wall 14 is installed at a position spaced apart from the rear wall of the inner cabinet 12 to the front side so that a space where the deep-freezing chamber storage system is placed and a space where the main evaporator 54 is placed are divided. The cooled air cooled by the main evaporator 54 is supplied to the freezing chamber 13 and then returned to the main evaporator 54. The cooled air cooled by the main evaporator 54 is not supplied to the drawer assembly 30. The case 31 is made of a heat insulating material so that the inner portion of the freezing chamber 13 and the inner portion of the storage box 322 cannot exchange heat with each other.

In addition, the exothermic surface of the thermoelectric device 41 is attached to the surface of the heat conduction unit 44 and thus is cooled and the heat sink 42 is attached to the endothermic surface of the thermoelectric device 41 and thus the heat sink 42 is cooled to minus 50 degrees Celsius or less. The cooled air in the deep-freezing storage chamber which is sucked by the cooling fan 43 is rapidly cooled to minus 50 degrees Celsius while exchanging heat with the heat sink 42.

Specifically, the temperature of the refrigerant passing through the auxiliary evaporator 45 is about minus 35 degrees Celsius and the temperature of the exothermic surface of the thermoelectric device 41 is about minus 30 degrees Celsius. When a current flows through the thermoelectric device 41, the temperature difference between the exothermic surface and the endothermic surface becomes about 25 degrees. Therefore, the temperature of the endothermic surface of the thermoelectric device 41 is about minus 55 degrees Celsius. The cooled air temperature of the deep-freezing storage chamber, which is in contact with the endothermic surface of the thermoelectric device 41 and exchanges heat, is about minus 50 degrees Celsius.

The invention claimed is:

1. A refrigerator, comprising:

a cabinet including a freezing compartment and an evaporation chamber;

a dividing wall that partitions the freezing compartment and the evaporation chamber;

a main evaporator installed in the evaporation chamber;

a case disposed in the freezing compartment, the case having a rear end attached to a front surface of the dividing wall;

a chamber cover that divides an inner space of the case into a deep-freezing storage chamber and a deep-freezing evaporation chamber, the chamber cover comprising a discharge grille and a suction grille that are on a front surface of the chamber cover;

a drawer withdrawably received in the deep-freezing storage chamber;

an auxiliary evaporator received in the deep-freezing evaporation chamber; and a deep cooling module that is received in the deep-freezing evaporation chamber, that is coupled to the auxiliary evaporator, and that is configured to cool the deep-freezing storage chamber to a deep cooling temperature that is lower than a temperature of the freezing compartment, wherein the deep cooling module includes:

a heat conduction unit that covers a refrigerant pipe of the auxiliary evaporator, the heat conduction unit having a rear surface that faces a front surface of the dividing wall and that is spaced apart from a front surface of the dividing wall;

a thermoelectric device comprising:

an exothermic surface that is attached to a front surface of the heat conduction unit and that is configured to transfer heat to refrigerant in the refrigerant pipe of the auxiliary evaporator by conduction through the heat conduction unit, and an endothermic surface that is located on an opposite side of the thermoelectric device relative to the exothermic surface;

a heat sink attached to the endothermic surface of the thermoelectric device and configured to absorb heat from cold air in the deep-freezing storage chamber and to transfer heat to the endothermic surface; and a cooling fan located in front of the heat sink.

2. The refrigerator according to claim 1, wherein:

the discharge grille is configured to discharge cooled air from the deep-freezing evaporation chamber to the deep-freezing storage chamber; and the suction grille is located below the discharge grille and allows the cooled air to return from the deep-freezing storage chamber to the deep-freezing evaporation chamber.

3. The refrigerator according to claim 1, wherein at least a portion of the heat conduction unit is located between the refrigerant pipe of the auxiliary evaporator and the exothermic surface of the thermoelectric device.

4. The refrigerator according to claim 1, wherein at least a portion of the heat conduction unit is located between the refrigerant pipe of the auxiliary evaporator and the front surface of the dividing wall.

5. The refrigerator according to claim 1, wherein the heat conduction unit comprises a pair of plates coupled to each other, the pair of plates comprising:

a front plate that defines the front surface of the heat conduction unit and that faces the exothermic surface of the thermoelectric device; and a rear plate that defines the rear surface of the heat conduction unit and that faces the front surface of the dividing wall, and wherein the refrigerant pipe of the auxiliary evaporator is disposed between the front plate and the rear plate of the heat conduction unit.

6. The refrigerator according to claim 1, wherein the chamber cover comprises:

a first portion that extends into the case to thereby define the deep-freezing evaporation chamber inside the case; and a second portion that is bent and extends outward from a rear end of the first portion and that is disposed between a rear end of the case and the front surface of the dividing wall.

7. The refrigerator according to claim 6, wherein the second portion of the chamber cover contacts the rear end of the case and the front surface of the dividing wall.

8. The refrigerator according to claim 6, wherein the deep-freezing evaporation chamber is disposed rearward of the first portion of the chamber cover, and the deep-freezing storage chamber is disposed forward of the first portion of the chamber cover.

9. The refrigerator according to claim 1, wherein the heat conduction unit is disposed inside of the deep-freezing evaporation chamber at a position forward of the front surface of the dividing wall.

* * * * *